US010434679B2

(12) United States Patent
Laster

(10) Patent No.: US 10,434,679 B2
(45) Date of Patent: Oct. 8, 2019

(54) STATIONARY BOX LUMBER SHAVING MILL WITH A LUMBER ARRESTOR

(71) Applicant: Newman Machine Company, Inc., Browns Summit, NC (US)

(72) Inventor: James E. Laster, Greensboro, NC (US)

(73) Assignee: NEWMAN MACHINE COMPANY, INC., Browns Summit, NC (US)

( * ) Notice: Subject to any disclaimer, the term of this patent is extended or adjusted under 35 U.S.C. 154(b) by 453 days.

(21) Appl. No.: 15/178,118

(22) Filed: Jun. 9, 2016

(65) Prior Publication Data

US 2017/0355099 A1 Dec. 14, 2017

(51) Int. Cl.
*B27L 11/02* (2006.01)

(52) U.S. Cl.
CPC ..... *B27L 11/02* (2013.01)

(58) Field of Classification Search
CPC .. B27C 5/00; B27C 1/00; B27C 1/002; B27C 1/005; B27C 1/007; B27C 1/02; B27C 1/04; B27C 1/12; B27C 1/14; B27L 11/02; B27L 11/04
USPC .... 144/162.1, 163, 165, 166, 177, 178, 180; 241/199.3, 147, 148
See application file for complete search history.

(56) References Cited

U.S. PATENT DOCUMENTS 1,730,376 A * 10/1929 Miller ..... B27L 5/06 144/180
2,951,518 A 9/1960 Cumpston, Jr.
3,330,318 A * 7/1967 Tschantz ..... B02C 18/02 144/178
3,344,828 A * 10/1967 Kirsten ..... B27L 11/002 144/180
4,185,787 A * 1/1980 Plyler ..... B27L 11/02 144/178
5,029,625 A * 7/1991 Diemer ..... B27L 11/005 144/162.1
5,070,918 A * 12/1991 Pallmann ..... B23Q 7/06 144/172

OTHER PUBLICATIONS

Douglas Shaving Mill. 3 pages. Accessed Aug. 26, 2016 at http://www.douglasmachineshopinc.net/shavingmill.html. Douglas Machine Shop, Mount Croghan, SC.
Jackson Wood Shaving Mill. 5 pages. Accessed Aug. 26, 2016 at http://wwww.jacksonlbrharvester.com/shavingmills.html. Jackson Lumber Harvester Co., Inc., Mondovi, WI.
Nuk593 Wood Shaving Machine. 1 page. Accessed Aug. 29, 2016 at http://www.nukor.co.za/nukor-wood-shaving-machine.html. NUKOR, Jeppestown, South Africa.

* cited by examiner

*Primary Examiner* — Matthew Katcoff
(74) *Attorney, Agent, or Firm* — Coats & Bennett, PLLC

(57) ABSTRACT

A device and method for cutting lumber pieces into shavings. The device includes a hopper sized to hold the lumber pieces that are to be cut into the shavings, and a carriage that is positioned below the hopper. The carriage includes a support platform to support the lumber pieces that are in the hopper, and cutterheads spaced apart along the support platform. The carriage is movable relative to the hopper to move the cutterheads back and forth along the lumber pieces during the cutting. An arrestor maintains the lumber pieces in position relative to the hopper when the carriage is moving in one direction to prevent and/or reduce the lumber pieces from moving and thus not being completely cut by the carriage.

19 Claims, 11 Drawing Sheets

STATIONARY BOX LUMBER SHAVING MILL WITH A LUMBER ARRESTOR

BACKGROUND

Wood shavings are generally thin pieces of wood that are cut from a piece of lumber. Wood shavings are used for a variety of different applications. A main application is for animal care, such as for bedding material for horses, livestock, poultry, and other outdoor animals. The wood shavings have excellent absorbency properties and take up moisture quickly and dry quickly. Further, the shavings are soft and comfortable for the animals. Although animal care is a primary use, shavings are also used for other applications.

The wood shavings are generally cut from an elongated piece of lumber. The lumber may include logs that have been de-branched. The lumber pieces may have various diameters depending upon the size of the trees and the capacity of the cutting equipment. The lumber may also include various waste wood such as scrap boards.

The manufacturing process for producing the shavings includes moving a cutter along the elongated lumber pieces and cutting off the shavings. The cutter may be equipped to move in a reciprocating (i.e., back-and-forth) manner along the lumber. The cutter cuts a predetermined amount from the pieces while moving back and forth in a reciprocating manner. The amount of wood shavings cut from the lumber during a pass will vary depending upon a variety of factors, including but not limited to the type of lumber such as the hardness of the wood, speed and/or power of the cutter, and desired size of the wood shavings.

An issue that arises during the manufacturing process is maintaining the lumber stationary relative to the moving cutter. As the cutter is moving along the lumber during the cutting process, the lumber may move in the same direction as the cutter. This movement of the lumber with the cutter may prevent the entire length of the lumber from being cut. After several reciprocating passes, one or more sections of the lumber that has repeatedly not been cut may act as a block. This may prevent the cutter from making contact with the lumber during subsequent passes.

SUMMARY

The present application is directed to shaving mills and methods of shaving lumber. The application discloses various manners for maintaining the lumber stationary while the cutter moves along the lumber in a reciprocating fashion. This provides for the length of the lumber to be cut during each pass and prevents build-up of uncut sections that may act as a block to prevent cutting during subsequent cutter passes.

The devices and methods generally include a hopper for maintaining the lumber, and a movable carriage positioned underneath the hopper. The carriage supports the lumber and also includes two or more cutters. A holding device is positioned at the hopper to contact against the lumber and prevent movement during the cutting process. Thus, the amount of relative movement between the cutters and the lumber is reduced and/or eliminated.

One embodiment is directed to a shaving mill for shaving lumber pieces. The shaving mill includes a hopper with outer walls that extend around and define an interior space to contain the lumber pieces. The hopper also includes an open bottom at lower edges of the outer walls. A carriage is positioned below the hopper and includes a support platform to support the lumber pieces that are in the hopper, and at least one cutterhead. The carriage is movable relative to the hopper along a reciprocating axis in forward and rearward directions. An arrestor is positioned at the open bottom of the hopper and includes a first actuator and a first contact member. The first actuator is configured to move the first contact member between a deployed position and a retracted position. The shaving mill is operable to shave the lumber pieces in first and second modes. The first mode includes the carriage moving along the reciprocating axis in the forward direction and the first contact member being in the retracted position. The second mode includes the carriage moving along the reciprocating axis in the rearward direction and the first contact member in the deployed position. The contact member is positioned in closer proximity to a center of the open bottom in the deployed position than in the retracted position.

The hopper may include a cut-out section along one of the outer walls at the lower edge. The cut-out section is continuous with the open bottom and the interior space and the arrestor is positioned at the cut-out section such that the contact member extends through the cut-out section and into the interior space in the deployed position.

The arrestor may include a mount to connect the arrestor to the hopper such that the arrestor is stationary relative to the carriage.

The carriage may include the support platform being substantially flat with multiple cutterheads evenly-spaced apart along the support platform. Each of the cutterheads includes a circular body with radially-extending blades.

The first contact member may include elongated arms that are connected to a plate with the plate positioned perpendicular to the reciprocating axis.

The arrestor may include a second actuator and a second contact member that is movable between the deployed position and the retracted position. The second contact member is spaced apart from the first contact member in a plane that is perpendicular to the reciprocating axis.

The shaving mill may include a control circuit configured to move the arrestor to the deployed position from the retracted position upon determining that the carriage has finished moving in the forward direction.

The reciprocating axis may be perpendicular to the at least one cutterheads.

Another embodiment is directed to a shaving mill for shaving lumber pieces. The shaving mill includes a hopper with enclosed side walls that define an interior space sized to contain the lumber pieces. The hopper has an open top at upper edges of the side walls and an open bottom at lower edges of the side walls. A carriage is positioned below the hopper and includes a support platform to support the lumber pieces that are in the hopper. The carriage also includes cutterheads that are spaced apart along a length of the support platform. The carriage is movable relative to the hopper along a reciprocating axis in forward and rearward directions. An arrestor is positioned at the open bottom of the hopper and includes a contact member configured to move along the reciprocating axis between a deployed position that is positioned within the interior space of the hopper and a retracted position that is positioned out of the interior space. The shaving mill is operable to shave the lumber pieces in first and second modes. The first mode includes the carriage moving along the reciprocating axis in the forward direction and the contact member in the retracted position. The second mode includes the carriage moving along the reciprocating axis in the rearward direction and the contact member in the deployed position.

The contact member of the arrestor may include elongated rods that are mounted at the open bottom of the hopper and that extend across a width of the support platform, with the width being perpendicular to the reciprocating axis.

The arrestor may include actuators connected to each of the elongated rods to move the rods between the deployed and retracted positions.

The hopper may include an opening in one of the side walls with the contact member sized to fit through the opening and into the interior space when positioned in the extended position.

The arrestor may include a mount to connect the arrestor to the hopper such that the arrestor is stationary relative to the carriage.

The shaving mill may include a control circuit configured to control the shaving mill and to move the arrestor to the retracted position when the carriage is moving in the forward direction and to move the arrestor to the deployed position when the carriage is moving in the rearward direction.

Another embodiment is directed to a method of shaving a lumber piece. The method includes positioning an elongated lumber piece in a hopper with the lumber piece resting at a bottom of the hopper against a support platform that includes spaced-apart cutterheads, a first longitudinal end of the lumber piece is in proximity to a first end of the hopper and a second longitudinal end of the lumber piece is in proximity to an opposing second end of the hopper. The method includes moving the carriage in a first direction relative to the hopper and causing the first end of the lumber piece to contact against the first end of the hopper. The method includes maintaining the first end of the lumber piece against the first end of the hopper and preventing the lumber piece from moving relative to the carriage and shaving a bottom side of the lumber piece with the cutterheads as the carriage moves along the lumber piece in the first direction. The method includes while the carriage is moving in the first direction, positioning an arrestor located at the second end of the hopper in a retracted position away from the lumber piece. The method includes moving the carriage in an opposing second direction relative to the hopper. The method includes positioning the arrestor in an extended position in contact with the second end of the lumber piece. The method also includes maintaining the arrestor against the second end of the lumber piece and preventing the lumber piece from moving relative to the carriage and shaving the bottom side of the lumber piece with the cutterheads as the carriage moves along the lumber piece in the second direction.

The method may include positioning the arrestor in the extended position in contact with the second end of the lumber piece prior to the carriage beginning to move in the second direction.

The method may include moving the carriage in the second direction and moving the first end of the lumber piece away from the first end of the hopper.

The method may include moving an elongated rod through an opening in the hopper and against the second end of the lumber piece when moving the arrestor from the retracted position to the extended position.

The method may include activating an actuator and moving a contact member away from the actuator when moving the arrestor from the retracted position to the extended position.

The various aspects of the various embodiments may be used alone or in any combination, as is desired.

DETAILED DESCRIPTION

The present application is directed to a device to cut lumber pieces into shavings. The device generally includes a hopper sized to hold the lumber pieces that are to be cut into the shavings, and a carriage that is positioned below the hopper. The carriage includes a support platform to support the lumber pieces that are in the hopper, and cutterheads spaced along the support platform. The carriage is movable relative to the hopper to move the cutterheads back and forth along the lumber pieces during the cutting. An arrestor maintains the lumber pieces in position relative to the hopper when the carriage is moving in one direction to prevent and/or reduce the lumber pieces from moving and thus not being completely cut by the carriage.

Figure 1:
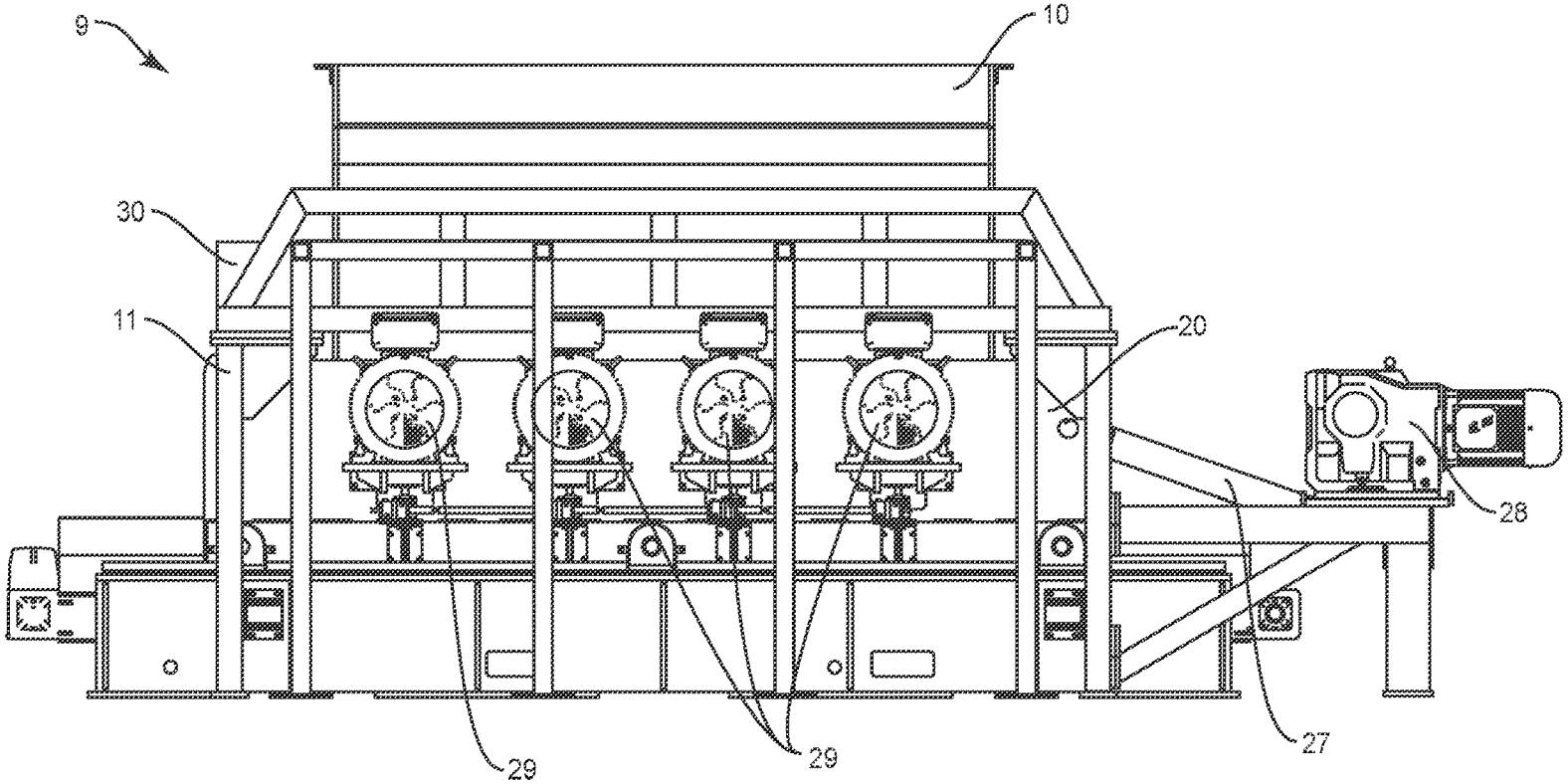
FIG. 1 is a side view of a shaving mill.

FIG. 1 illustrates a side view of the device 9 that includes the hopper 10, carriage 20, and arrestor 30. The hopper 10 is sized to hold lumber pieces that are to be cut during the process. The hopper 10 may be mounted on a frame 11 that extends over the carriage 20. The carriage 20 is positioned below the hopper 10 to support the lumber pieces. An arm 27 and motor 28 are mounted to the frame 11. The arm 27 is further connected to the carriage 20 to move the carriage 20 relative to the hopper 10 (and the lumber pieces) in a reciprocating back-and-forth motion. A conveyor (not illustrated) may be located under the carriage 20 to receive the cut shavings and transport them away from the device 9.

Figure 2:
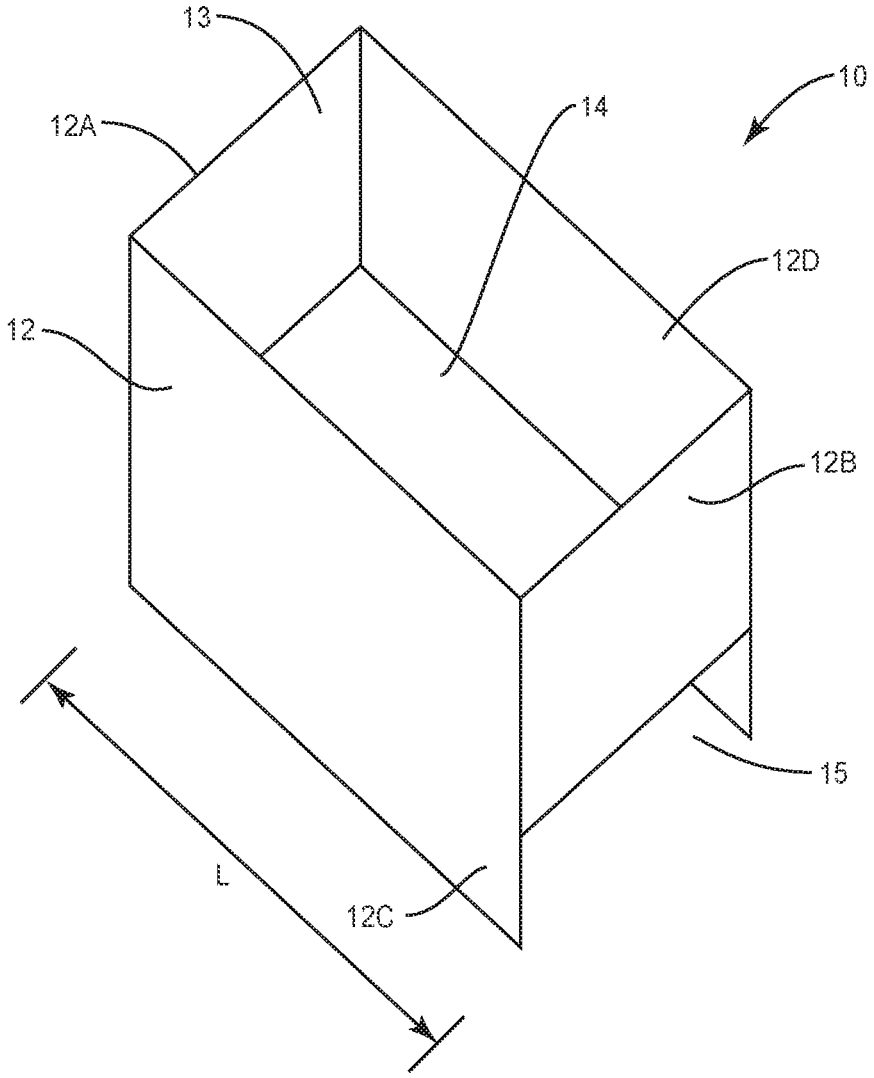
FIG. 2 is a perspective view of a hopper configured to hold lumber.

The hopper 10 is sized to hold the lumber pieces 100 that are to be shaved by the cutterheads 21 of the carriage 20. FIG. 2 illustrates a hopper 10 that includes sidewalls 12 that extend around and form an interior space sized hold the lumber pieces. The hopper 10 further includes an open bottom 14 at the lower edges of the sidewalls 12, and an open top 13 at the upper edges of the sidewalls 12. The open bottom 14 provides for the lumber pieces to contact against the carriage 20. The open top 13 provides for the lumber pieces 100 to be loaded into the hopper 10 from above. The hopper 10 includes a length L measured between opposing sidewalls 12*a*, 12*b*. The length L is sized to be greater than a length of the lumber pieces 100 such that the lumber pieces 100 lay directly on the carriage 20. The hopper 10 may include a rectangular shape formed by a first pair of opposing walls 12*a*, 12*b*, and a second pair of opposing walls 12*c*, 12*d*. The hopper 10 includes a major axis that extends between walls 12*a*, 12*b*, and a minor axis perpendicular to and extending between walls 12*c*, 12*d*. The length L measured along the major axis provides for the lumber pieces to be positioned in the hopper 10 in alignment with the first and second walls 12*a*, 12*b*. That is, the ends of the lumber pieces 100 face the walls 12*a*, 12*b*.

A cut-out section 15 is formed at the bottom edge of sidewall 12*b*. This cut-out section 15 is continuous with the interior space and the open bottom 14 of the hopper 10. The cut-out section 15 provides for the arrestor 30 to contact against the lumber pieces 100 as will be explained in detail below.

The arrestor 30 is positioned at the cut-out section 15 and is configured to contact against the ends of the lumber pieces 100 in the hopper 10. The arrestor 30 applies a force to maintain their position relative to the hopper 10 when the carriage 20 is moving in one direction.

Figure 3:
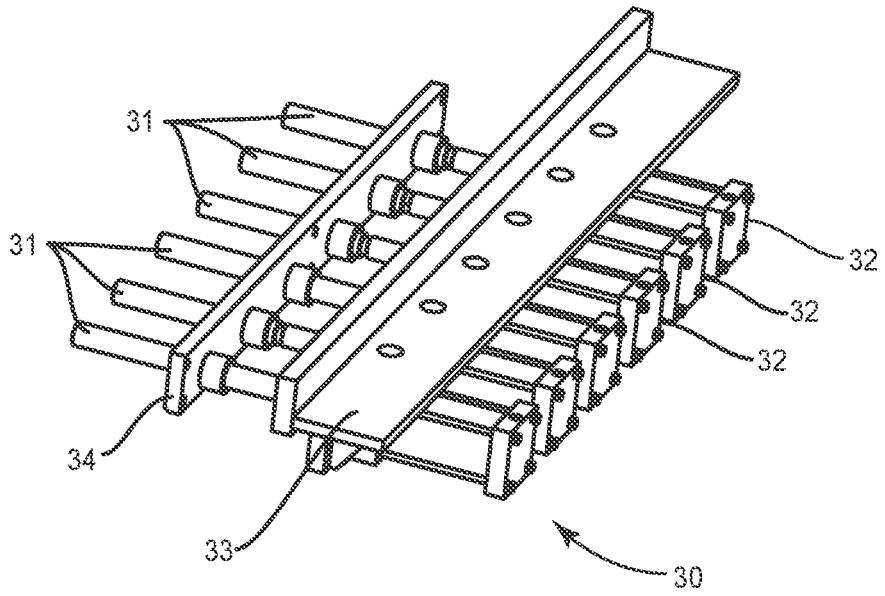
FIG. 3 is a perspective view of an arrestor.

As illustrated in FIG. 3, the arrestor 30 comprises a row of rods 31. The rods 31 each include an exposed end that contacts against a lumber piece 100, and a second end that is positioned in a corresponding actuator 32. The actuators 32 provide a force to each of the rods 31 to move the rods 31 between extended and retracted positions. The amount of force applied to each rod 31 may vary. The actuators 32 may be powered through a variety of sources, including but not limited to pneumatic, hydraulic, and electrical power.

The arrestor 30 includes a bracket mount 33 to connect with the frame 11 of the hopper 10. The arrestor 30 may also include a guide plate 34 that includes openings through which the rods 31 extend. In an extended position, the rods 31 are extended a first amount outward beyond the guide place 34, and in a retracted position extend outward a lesser distance from the guide plate 34.

Figure 4:
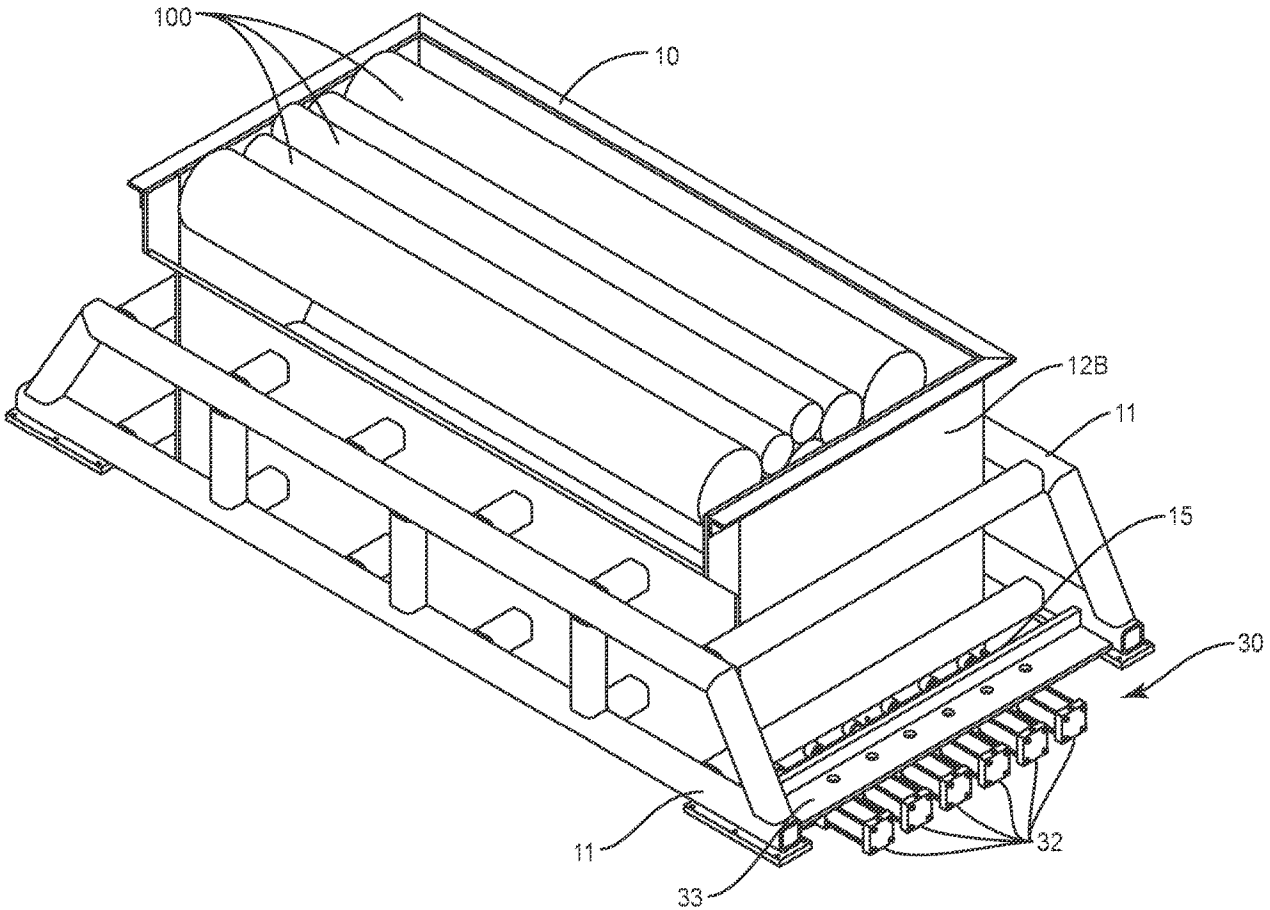
FIG. 4 is a perspective view of a hopper positioned within a frame and with the arrestor positioned at a cut-out section of the hopper.

FIG. 4 illustrates the arrestor 30 positioned at the cut-out section 15 of the hopper 10. The arrestor 30 is positioned relative to the hopper 10 by the bracket mount 33 that is connected to the frame 11. This positions the rods 31 and actuators 32 at the cut-out section 15 such that the exposed ends of the rods 31 can extend into the interior space hopper 10 when in the extended position. In the retracted position, the rods 31 do not extend into the interior space. The arrestor 30 is sized to extend across the width of the hopper 10. The rods 31 can then contact against and provide positioning for each of the lumber pieces 100 in the bottom of the hopper 10 that are being acted on by the carriage 20.

Figure 5:
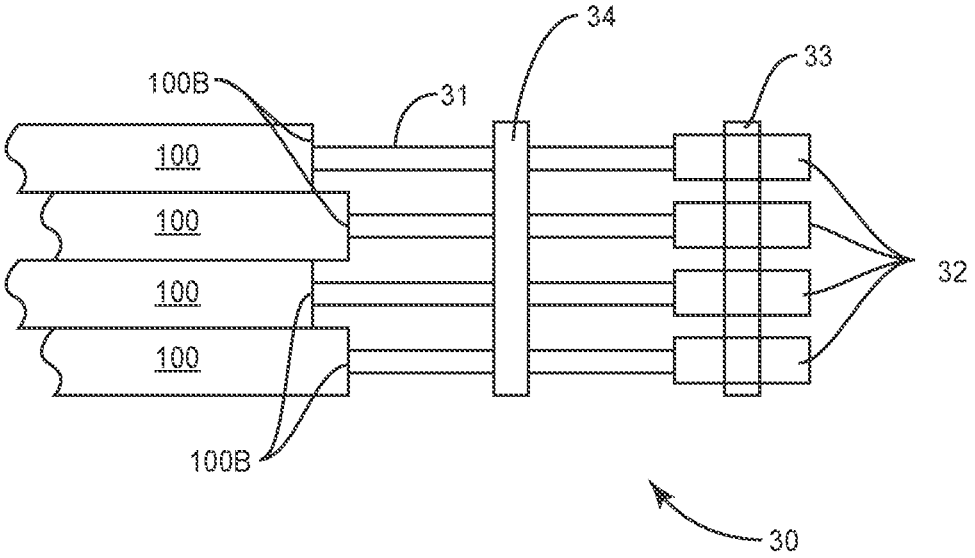
FIG. 5 is a top schematic view of an arrestor in an extended position to contact against logs in a hopper.

FIG. 5 illustrates the arrestor 30 comprising four sets of actuators 32 and rods 31. The rods 31 are in the extended position and in contact with the ends 100*b* of the logs 100. The separate rods 31 that extend across the width of the carriage 20 provide for contact with each of the logs 100. Because the logs 100 may include different lengths, the ends 100*b* may be positioned different distances away from the arrestor 30. The separate rods 31 are each separately extendable outward from their corresponding actuators 32 to contact against the logs 100. Thus, the different rods 31 may extend outward from their respective actuators 32 dependent upon the lengths of the different logs 100. Each rod 31 also includes a limiter to prevent over-extension from their respective actuator 32. In the event that a rod 31 is not long enough to contact against a log 100, the rod 31 will remain extended and the log 100 may shift slightly within the hopper 10 during cutting by the carriage which causes the log 100 to be moved into contact. Once in contact, the rod 31 prevents further movement of the log 100 in the hopper 10.

Figure 6:
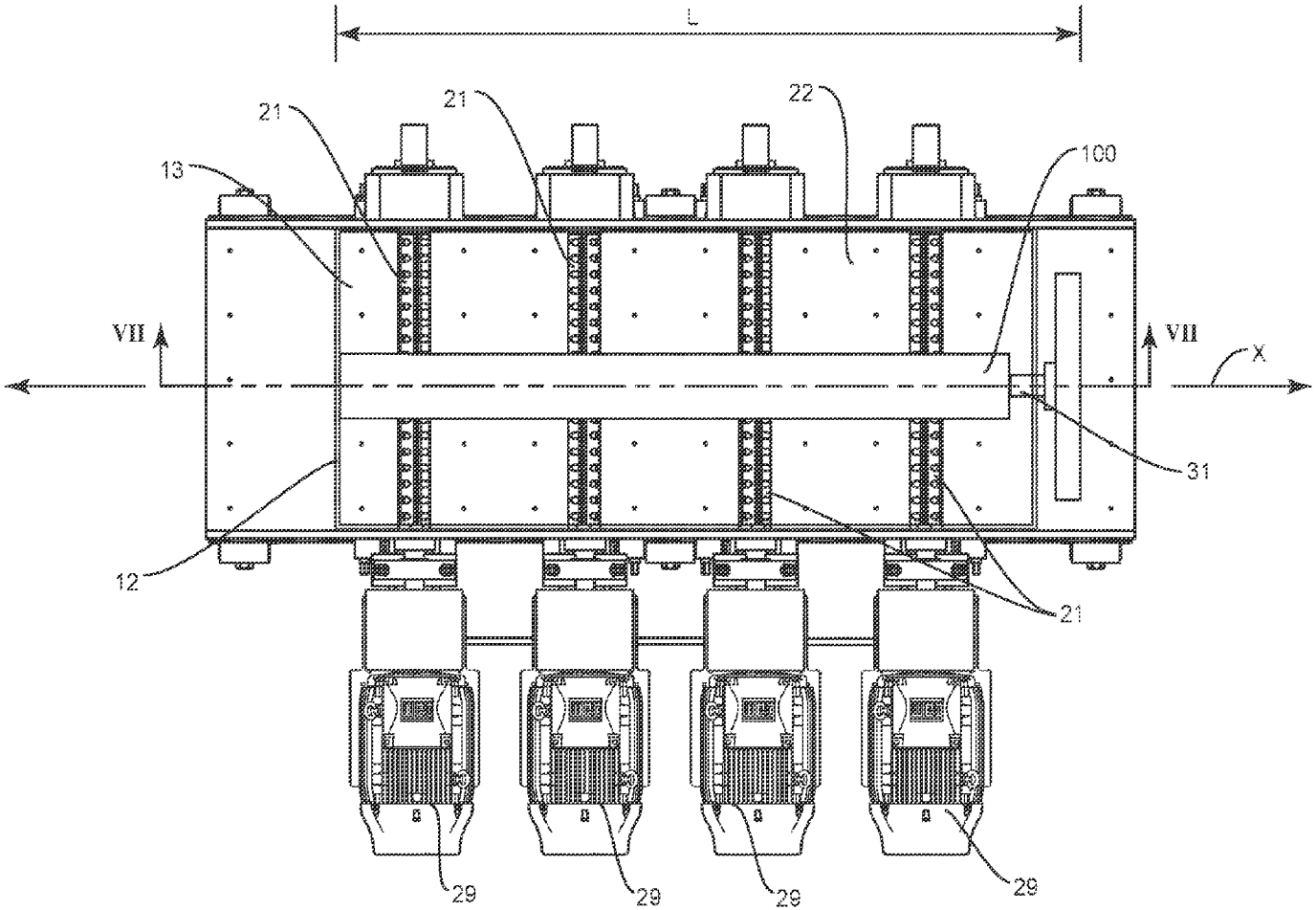
FIG. 6 is a top schematic view of a piece of lumber moving along a carriage.
Figure 7:
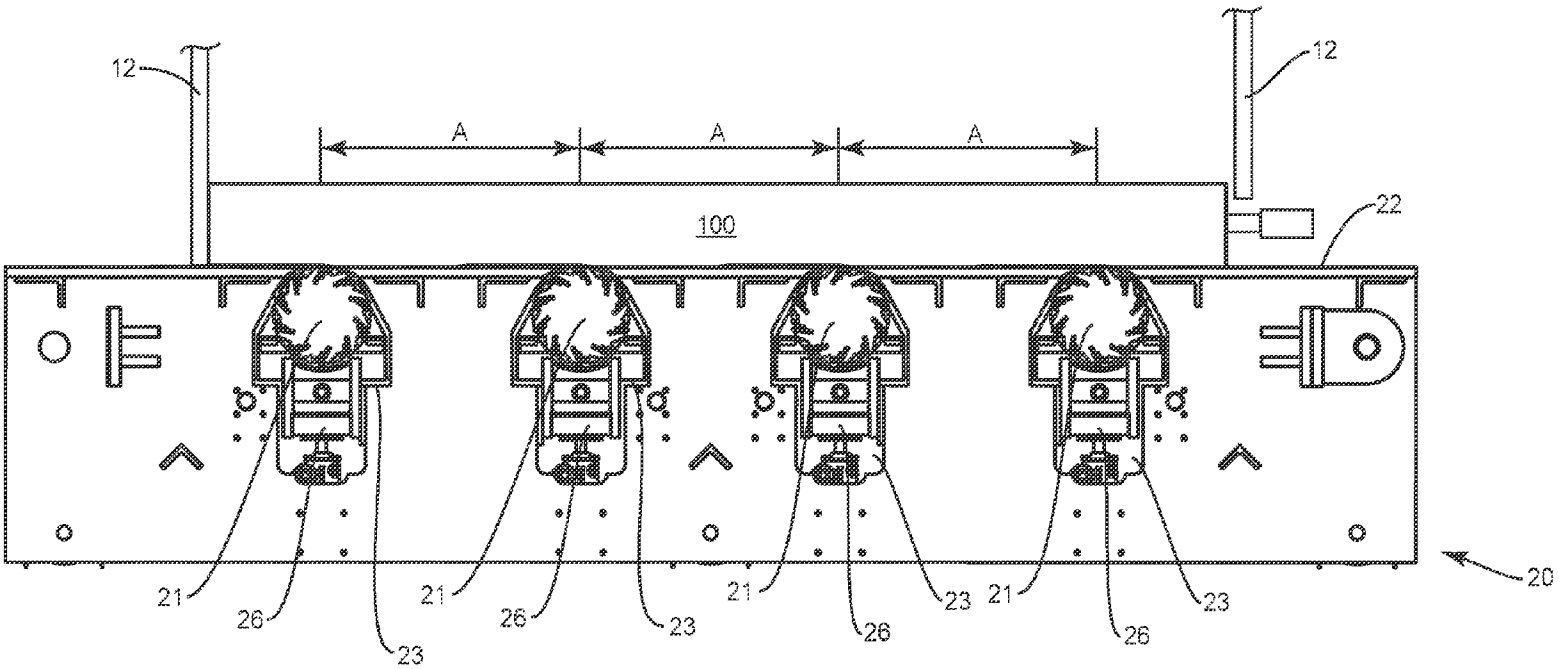
FIG. 7 is a side schematic view cut along line V-V of FIG. 5 of the carriage and lumber piece.

FIGS. 6 and 7 illustrate a single lumber piece 100 positioned on the carriage 20. For purposes of clarity, only a single lumber piece 100 is positioned on the carriage 20. It is understood that the device 9 is configured to simultaneously process multiple lumber pieces 100 that are each positioned in the hopper 10, are contacting against the support platform 21, and are being cut by the cutterheads 21.

The carriage 20 is positioned below the hopper 10 and includes a support platform 22 that supports the lumber pieces 100. The support platform 22 is flat to support the lumber piece 100. The support platform 22 includes a length that is longer than the length L of the hopper 10. This provides for the support platform 22 to remain underneath the lumber pieces 100 as the carriage 20 moves along a reciprocating axis that is illustrated by the line X-X.

The carriage 20 includes two or more cutterheads 21 that are spaced apart along the support platform 22. FIGS. 6 and 7 include an embodiment with four (4) cutterheads 21 spaced apart along the support platform 22. The cutterheads 21 are equally-spaced apart by a common distance A. Each cutterhead 21 includes a body with one or more blades that extend radially outward to remove portions of the bottom side of the lumber piece 100. The cutterheads 21 may include a cylindrical body with outwardly-extending blades. A motor 29 powers each of the cutterheads 21. Because of the numerous cutterheads 21 that are spaced apart along the reciprocating axis, the carriage 20 only moves an amount approximately equal to the distance between the cutterheads 21. This distance is illustrated as A in FIG. 7. As illustrated in FIG. 1, the motor 28 and arm 27 provide for moving the carriage 20 in this reciprocating manner.

The cutterheads 21 are adjustable relative to the support platform 22 to adjust the amount of the blade that is exposed above the surface of the support platform 22. The adjustment provides for removing different amounts from the bottom of the lumber piece 100. An adjustment device 26 is positioned at each cutterhead 21 and is configured to adjust the position of the body and blades relative to the support platform 22. The adjustment device 26 may include various configurations, including a pneumatic or hydraulic cylinder with a base and outwardly extending arm, or a screw jack.

The cutterheads 21 are positioned in openings 23 in the carriage 20 to provide for their removal in a direction that is perpendicular to the reciprocating axis of the carriage 20. This facilitates removal and maintenance of the cutterheads 21 from the carriage 20 for maintenance and/or replacement.

FIGS. 8A-8E schematically illustrate a lumber piece 100 being cut by the device 9. The carriage 20 includes four cutterheads 21 that are spaced apart along the support platform 22. For simplicity, the drawings include a single lumber piece 100 positioned in the hopper 10, and the arrestor 30 including a single rod 31/actuator 32.

Figure 8A:
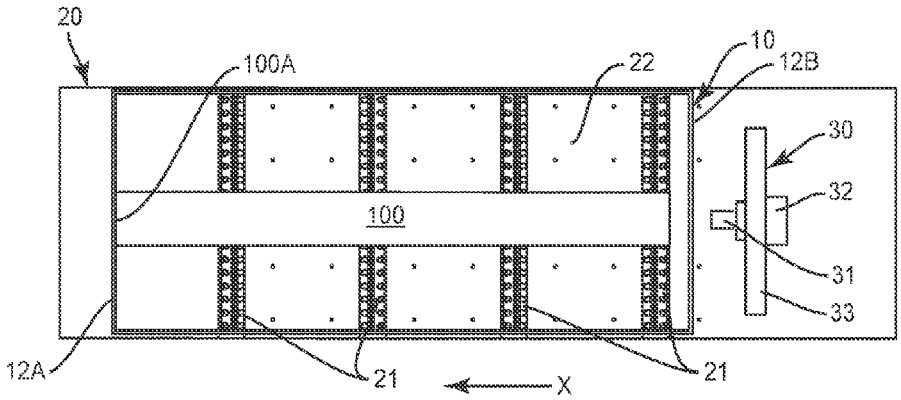
FIGS. 8A-8E are schematic top views of a lumber piece positioned relative to a hopper, carriage, and arrestor during a processing cycle.

FIG. 8A illustrates the carriage 20 moving along the movement axis in the direction X. The hopper 10 remains stationary throughout the process. This movement of the carriage 20 relative to the hopper 10 applies a force to the lumber piece 100. This force maintains the lumber piece 10 positioned in the hopper 10 with the end 100*a* in contact against the sidewall 12*a*. This positioning provides for the cutterheads 21 to move relative to the lumber piece 100 to shave the bottom side of the lumber piece 100. The arrestor 30 is stationary relative to the carriage 20. The rod 31 is in a retracted position away from the lumber piece 100 and out of the interior space of the hopper 10.

Figure 8B:
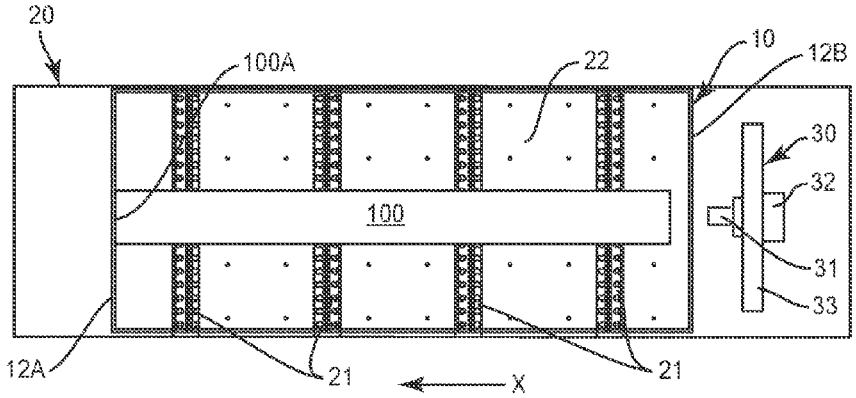

FIG. 8B illustrates the carriage 20 having moved farther in the X direction along the movement axis. This movement causes the cutterheads 21 to move along the bottom of the lumber piece 100 and shave the lumber piece 100. This movement direction also applies a force to maintain the end 100*a* of the lumber piece 100 against the wall 12*a* of the hopper 10. The arrestor 30 remains relatively stationary with the rod 31 remaining in the retracted position.

Figure 8C:
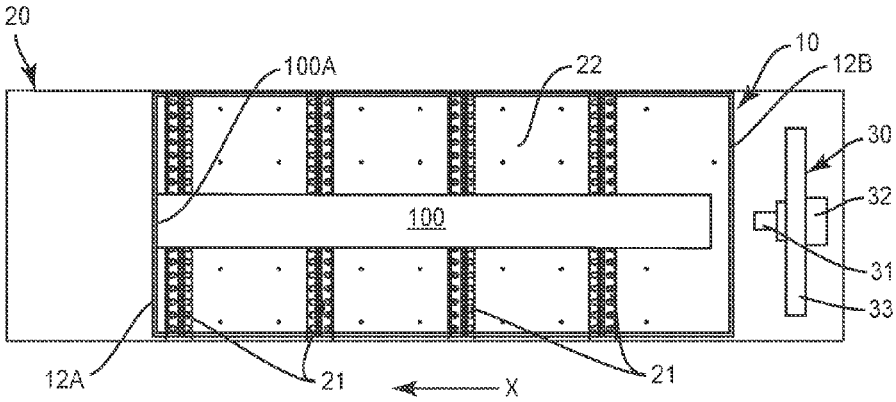

FIG. 8C illustrates the carriage 20 having moved to the farthest extent in the direction X along the movement axis. The rod 31 remains retracted away from the interior space of the hopper 10.

After completing the movement in one direction, the carriage 20 begins movement in the opposing direction along the movement axis. Due to the contact between the lumber piece 100 and the cutterheads 21 and support platform 22, the force of the moving cutterheads 21 against the lumber piece 100 will apply a force to the lumber piece 100 to move in the opposing direction (and to move relative to the hopper 10). Movement of the lumber piece 100 with the carriage 20 would prevent the entire underside of the lumber piece 100 from being cut. If this were to occur over one or more reciprocating cycles of the carriage 20, small sections of the underside of the lumber piece 100 would not be cut. These sections would remain in contact with the support platform 22 and prevent the cutterheads 21 from contacting the lumber piece 100 during subsequent passes.

To prevent this from occurring, the arrestor 30 contacts the lumber piece 100 and maintains it stationary relative to the carriage 20. At the time that the carriage 20 begins to move in the return direction, the rod 31 moves from the retracted position to the extended position. This places the end of the rod 31 in contact with the end 100*b* of the lumber piece 100. This contact prevents the lumber piece 100 from moving with the carriage 20 along the movement axis in the direction Y.

Figure 8D:
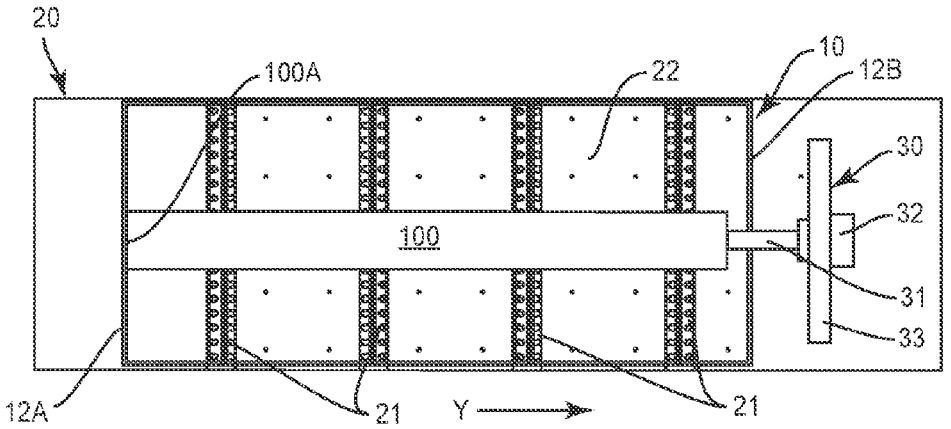

FIG. 8D illustrates the carriage 20 now moving in this opposing Y direction. The arrestor 30 is in the extended position with the end of the rod 31 being extended and in contact with the lumber piece end 100*b*. This contact maintains the lumber piece 100 positioned relative to the hopper 10. In one embodiment, the lumber piece end 100*a* remains in contact with the end 12*a* of the hopper 10. Thus, the lumber piece 100 remains stationary along the movement axis as the carriage 20 moves in the direction Y. While the log 100 is prevented from moving, the carriage 20 moves along the length of the log 100 and cuts the underside.

Depending upon the lengths of the log 100, hopper 10, and arm 31, the log 100 may move a small distance along the movement access when the carriage 20 starts moving in the return direction. However, this amount is relatively small and limited by the contact with the rod 31 once the log 100 moves into contact.

Figure 8E:
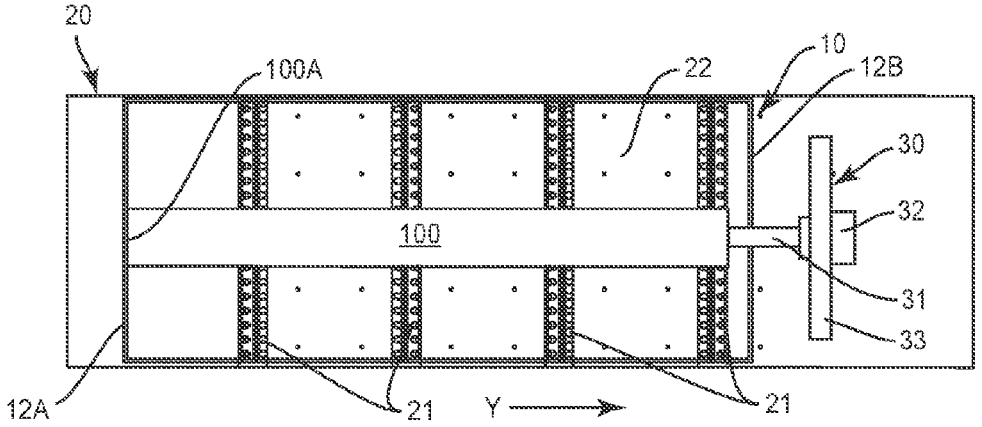

FIG. 8E illustrates the carriage 20 having moved a greater distance in the direction Y along the movement axis. The rod 31 remains in contact with the lumber piece 100 thus maintaining its relative position within the hopper 10. The carriage 20 has continued to move along the movement axis and has completed the cut along the bottom of the lumber piece 100.

Additional processing of the lumber piece 100 includes the carriage 20 again reciprocating and moving in the opposing direction X. When the carriage 20 changes directions along the movement axis, the arrestor 30 moves to the retracted position with the rod 31 moving away from and out of contact with the lumber piece 100.

Figure 9:
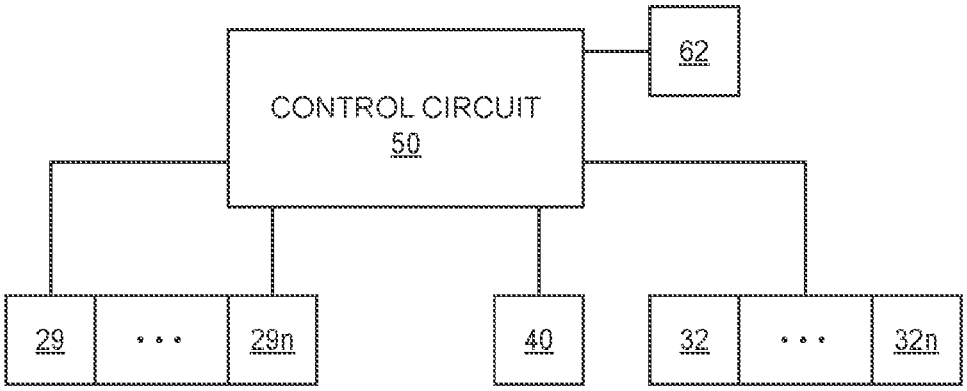
FIG. 9 is a schematic diagram of a control circuit of a shaving mill.
Figure 10:
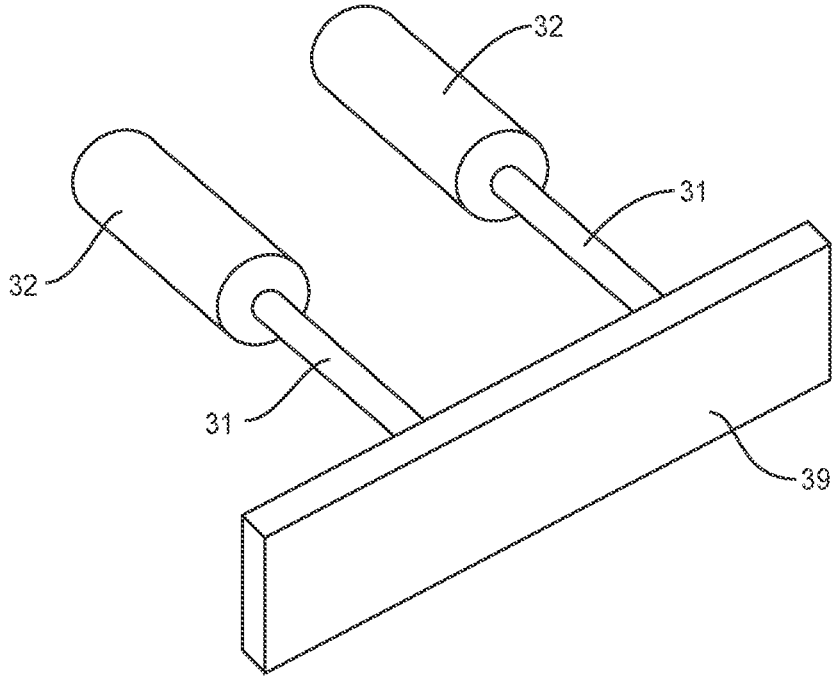
FIG. 10 is a perspective view of actuators, rods, and a plate of an arrestor.

The device 10 may include one or, more control circuits 50 that oversee the cutting process. FIG. 9 illustrates a device 10 having a single control circuit 50. The control circuit may be integrated with the device 9, or may be located remotely and connected to the device through cabling and/or wireless communications. The control circuit 50 includes one or more processors and/or microcontrollers that controls the overall operation according to program instructions stored in memory. Various types of memory may be included for storing program instructions and data needed for operation, and other memory for storing temporary data required to carry out its operation. Memory 43 may include one or several types of memory, including read-only memory, random-access memory, flash memory, magnetic or optical storage devices, or the like.

The control circuit 50 may also include a user interface that may include one or more user input devices such as a keypad, touchpad, function keys, scroll wheel, or other type of computer input device. A display may also be included, such as a conventional liquid crystal display (LCD) or touch screen display which also functions as a user input device.

The control circuit 50 communicates with the various elements of the device 9, including the one or more motors 29 that operate the cutterheads 21, one or more motors 28 that drive the carriage 20, and the one or more actuators 32 of the arrestor 30. The control circuit 50 receives and sends signals to each of the various components. In one embodiment, the control circuit 50 moves the arrestor 30 between the retracted and extended positions.

The control circuit 50 may place the arrestor 30 in the retracted position as the carriage 20 moves in the first direction. Upon the carriage 20 completing movement in the first direction, the control circuit 50 may then move the arrestor 30 to the extended position. This may include placing the arrestor 30 in the extended position when the carriage 20 is moving along the movement axis in a first direction, and to the retracted position when the carriage is moving in the opposing second direction.

The control circuit 50 may be configured to monitor the various motors 28, 29, 32 that are driving the various components to determine the relative positions. This monitoring provides for the control circuit 50 to move the arrestor 30 between the retracted and extended positions. One or more sensors 62 may also be included in the device 9 to sense the position of the various components. The sensors 62 send the location information to the control circuit 50 which uses these inputs to control the arrestor 30. In one embodiment, one or more sensors 62 are positioned to detect when the carriage 20 has complete movement in the two directions along the movement axis.

In the embodiment described above, the arrestor 30 includes one or more rods 31 that contact against the logs 100. The arrestor 30 may also include a contact plate 39 positioned at the ends of one or more of the rods 31. The plate 39 may include various sizes and may be connected to various numbers of actuators 32/rods 31. The plate 39 may be sized to extend completely across the width of the support platform 22. Alternatively, the plate 39 may be sized to extend across a limited portion of the width with the arrestor 30 includes two or more plates 39.

The arrestor 30 may be positioned with the actuators 32 positioned away from the interior of the hopper 10. The device 9 may also be configured for the arrestor 30 to be positioned in the interior space of the hopper 10. A plate or other protective device may extend over the actuators 32 to protect them from the logs 100.

In another embodiment, the hopper 10 does not include a cut-out section 15. Rather, one or more openings are formed in one of the sidewalls 12*a*, 12*b*. Each opening is sized for a rod 31 to extend through in the extended position to contact against the logs 100.

The embodiments described above include a single arrestor 30 positioned at one of the ends of the hopper 10. Another embodiment may include a second arrestor 30 positioned at the opposing end of the hopper 10. In use, a first arrestor 30 may be in the extended position to contact a first end of the logs 100 to prevent movement while the carriage is moving in a first direction. A second arrestor 30 moves to the extended position to contact a second end of the logs to prevent movement while the carriage is moving in the second direction. The two arrestors 30 move to the retracted position when not in the extended position.

A control circuit 50 may oversee the operation of the device 9 as described above. The control circuit 50 may also include one or more relays that receives inputs and controls the operation of the device 9.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

What is claimed is:

1. A shaving mill for shaving lumber pieces, the shaving mill comprising:

a hopper with outer walls that extend around and define an interior space to contain the lumber pieces, the hopper comprising an open bottom at lower edges of the outer walls;

a carriage positioned vertically below the hopper and comprising a support platform to support the lumber pieces that are in the hopper, the carriage also comprising at least one cutterhead, the carriage being movable relative to the hopper along a reciprocating axis in forward and rearward directions;

an arrestor positioned at the open bottom of the hopper and comprising a first actuator and a first contact member, the first actuator configured to move the first contact member along the reciprocating axis between a deployed position and a retracted position;

the shaving mill operable to shave the lumber pieces in first and second modes with the first mode comprising the carriage moving along the reciprocating axis while positioned vertically below the hopper in the forward direction and the first contact member in the retracted position away from the lumber pieces and the second mode comprising the carriage moving along the reciprocating axis while positioned vertically below the hopper in the rearward direction and the first contact member in the deployed position in contact with the lumber pieces;

the contact member being positioned in closer proximity to a center of the open bottom in the deployed position than in the retracted position.

2. The shaving mill of claim 1, wherein the hopper further comprises a cut-out section along one of the outer walls at the lower edge, the cut-out section being continuous with the open bottom and the interior space, the arrestor positioned at the cut-out section such that the contact member extends through the cut-out section and into the interior space in the deployed position.

3. The shaving mill of claim 1, wherein the arrestor further comprises a mount to connect the arrestor to the hopper such that the arrestor is stationary relative to the carriage.

4. The shaving mill of claim 1, wherein the carriage comprises the support platform being substantially flat and comprising multiple cutterheads evenly-spaced apart along the support platform, each of the cutterheads comprising a circular body with radially-extending blades.

5. The shaving mill of claim 1, wherein the first contact member comprises a plurality of elongated arms that are connected to a plate with the plate positioned perpendicular to the reciprocating axis.

6. The shaving mill of claim 1, further comprising a second actuator and a second contact member that is movable along the reciprocating axis between the deployed position and the retracted position, the second contact member being spaced apart from the first contact member in a plane that is perpendicular to the reciprocating axis.

7. The shaving mill of claim 1, further comprising a control circuit configured to control the shaving mill and to move the arrestor to the deployed position from the retracted position upon determining that the carriage has finished moving in the forward direction.

8. The shaving mill of claim 1, further comprising the reciprocating axis being perpendicular to the at least one cutterheads.

9. A shaving mill for shaving lumber pieces, the shaving mill comprising:

a hopper with enclosed side walls that define an interior space sized to contain the lumber pieces, the hopper comprising an open top at upper edges of the side walls and an open bottom at lower edges of the side walls;

a carriage positioned vertically below the hopper and comprising a support platform to support the lumber pieces that are in the hopper and cutterheads that are spaced apart along a length of the support platform, the carriage being movable relative to the hopper along a reciprocating axis in forward and rearward directions;

an arrestor positioned at the open bottom of the hopper and comprising a contact member configured to move along the reciprocating axis between a deployed position that is positioned within the interior space of the hopper and a retracted position that is positioned out of the interior space;

the shaving mill operable to shave the lumber pieces in first and second modes with the first mode comprising the carriage moving along the reciprocating axis in the forward direction and the contact member in the retracted position and the second mode comprising the carriage moving along the reciprocating axis in the rearward direction and the contact member in the deployed position, the carriage moving in the first and second modes while being positioned vertically below the hopper.

10. The shaving mill of claim 9, wherein the contact member of the arrestor comprises a plurality of elongated rods that are mounted at the open bottom of the hopper and that extend across a width of the support platform, with the width being perpendicular to the reciprocating axis.

11. The shaving mill of claim 10, wherein the arrestor further comprises actuators that are each connected to one of the elongated rods to move the rods between the deployed and retracted positions.

12. The shaving mill of claim 9, wherein the hopper comprises an opening in one of the side walls with the contact member sized to fit through the opening and into the interior space when positioned in the extended position.

13. The shaving mill of claim 9, wherein the arrestor further comprises a mount to connect the arrestor to the hopper such that the arrestor is stationary relative to the carriage.

14. The shaving mill of claim 9, further comprising a control circuit configured to control the shaving mill and to move the arrestor to the retracted position when the carriage is moving in the forward direction and to move the arrestor to the deployed position when the carriage is moving in the rearward direction.

15. A method of shaving a lumber piece, the method comprising:

positioning an elongated lumber piece in a hopper with the lumber piece resting at a bottom of the hopper against a support platform that includes spaced-apart cutterheads, a first longitudinal end of the lumber piece in proximity to a first end of the hopper and a second longitudinal end of the lumber piece in proximity to an opposing second end of the hopper;

moving the carriage in a first direction relative to the hopper and causing the first end of the lumber piece to contact against the first end of the hopper;

maintaining the first end of the lumber piece against the first end of the hopper and preventing the lumber piece from moving and shaving a bottom side of the lumber piece with the cutterheads as the carriage moves along the lumber piece in the first direction;

while the carriage is moving in the first direction, positioning an arrestor located at the second end of the hopper in a retracted position away from the lumber piece;

moving the carriage in an opposing second direction relative to the hopper and positioning the arrestor in an extended position in contact with the second end of the lumber piece; and maintaining the arrestor against the second end of the lumber piece and preventing the lumber piece from moving and shaving the bottom side of the lumber piece with the cutterheads as the carriage moves along the lumber piece in the second direction.

16. The method of claim 15, further comprising positioning the arrestor in the extended position in contact with the second end of the lumber piece prior to the carriage beginning to move in the second direction.

17. The method of claim 15, further comprising moving the carriage in the second direction and moving the first end of the lumber piece away from the first end of the hopper.

18. The method of claim 15, further comprising moving an elongated rod through an opening in the hopper and against the second end of the lumber piece when moving the arrestor from the retracted position to the extended position.

19. The method of claim 15, further comprising activating an actuator and moving a contact member away from the actuator when moving the arrestor from the retracted position to the extended position.

* * * * *